US012352527B2

(12) United States Patent
Shi et al.

(10) Patent No.: US 12,352,527 B2
(45) Date of Patent: Jul. 8, 2025

(54) LINKAGE DUAL MODE RELEASE

(71) Applicant: Shenzhen Ravanon Sports Goods Co., Ltd., Shenzhen (CN)

(72) Inventors: Shenglei Shi, Shenzhen (CN); Wanli Fan, Shenzhen (CN); Fangwei Jiang, Shenzhen (CN)

(73) Assignee: SHENZHEN RAVANON SPORTS GOODS CO., LTD., Shenzhen (CN)

( * ) Notice: Subject to any disclaimer, the term of this patent is extended or adjusted under 35 U.S.C. 154(b) by 101 days.

(21) Appl. No.: 18/302,793

(22) Filed: Apr. 19, 2023

(65) Prior Publication Data

US 2024/0302127 A1 Sep. 12, 2024

(30) Foreign Application Priority Data

Mar. 9, 2023 (CN) ..... 202310221306.9

(51) Int. Cl.
*F41B 5/14* (2006.01)

(52) U.S. Cl.
CPC ..... *F41B 5/1469* (2013.01)

(58) Field of Classification Search
CPC ..... F41B 5/1469
USPC ..... 124/31, 33, 35.2
See application file for complete search history.

(56) References Cited

U.S. PATENT DOCUMENTS

| | | | | |
|---|---|---|---|---|
| 4,316,443 | A * | 2/1982 | Giacomo | F41B 5/1469 124/35.2 |
| 6,584,966 | B1 * | 7/2003 | Summers | F41B 5/1469 124/35.2 |
| 7,581,536 | B2 * | 9/2009 | Porter | F41B 5/1469 124/35.2 |
| 8,997,729 | B1 * | 4/2015 | Gillig | F41B 5/1469 124/35.2 |
| 9,982,961 | B1 * | 5/2018 | Rentz | F41B 5/1469 |
| 10,830,554 | B1 * | 11/2020 | Jones | F41B 5/1469 |
| 11,353,281 | B1 * | 6/2022 | Rentz | F41B 5/1469 |
| 11,428,500 | B2 * | 8/2022 | Langley | F41B 5/1469 |
| 11,940,242 | B1 * | 3/2024 | Rentz | F41B 5/1469 |
| 2016/0282079 | A1 * | 9/2016 | Rentz | F41B 5/1469 |
| 2022/0196362 | A1 * | 6/2022 | Dudley | F41B 5/1469 |

* cited by examiner

*Primary Examiner* — John E Simms, Jr.
(74) *Attorney, Agent, or Firm* — Zhigang Ma

(57) ABSTRACT

The linkage dual mode release includes a main body, a string hook, a linkage lock, a thumb trigger, a sear, and a trigger bar flange. The main body has a first finger groove arm. The string hook is elastically pivoted to one end of the main body for releasably hook to a bow string. The linkage lock is elastically pivoted to an outer surface of the main body, and the linkage lock is located adjacent the other end of the main body opposite to the string hook. The linkage lock has a locking arm and a lever arm extending to the main body. The thumb trigger is mounted to the linkage lock extending away from the main body. The sear is pivoted to the main body, a rest member is located between the sear and the main body, the sear comprises a second finger groove arm.

14 Claims, 3 Drawing Sheets

LINKAGE DUAL MODE RELEASE

This non-provisional patent application claims priority under 35 U.S.C. § 119 from Chinese Patent Application No. CN202310221306.9 filed on Mar. 9, 2023, the entire content of which is incorporated herein by reference.

TECHNICAL FIELD

The disclosure relates to the field of sports equipment technology, and in particular to a linkage dual mode release.

BACKGROUND

Compound bows are a kind of sports equipment and have very high theoretical archery accuracy and manufacturing accuracy that scores of the archery is no longer due to quality of the bow, but due to archers' ability to manipulate the bow and archers' psychological quality. A bow string of the compound bow is bound with D-ring. When shooting, release hooks the D-ring to pull the bow string, and then the D-ring is released from the release to finish the shooting.

The releases includes two main types. One type of the releases is a thumb trigger release which can release the D-ring by pulling trigger of the release with finger, such as U.S. patent Ser. No. 10/641,578B2. It disclosures a typical string hook grip release. The release usually works well, but some archers will suffer from panics about target. For example, after aiming and locking the target, attitudes of the archers are stationary, and it needs to pull or press the release, the archers will be anxious and then out of control slightly, and it results in inability to control release rhythm, and even appear problems of release failure and abnormal actions of the archers will occurs. Moreover, in order to reset the string hook after turning over, there is a reset component set in the release, which requires the archers to manually reset the string hook after each archery. And a spring of the reset component occupies a space of the release, which increases volume of the release.

Another type of the releases is a back tension release, which can make the archers draw the bow and press their shoulder blades together, in other words, the back tension release enables their backs tighten. The archers hold the releases in their hands, moving their backs and shoulders can move their hands, which causes the releases to rotate slightly to release the D-ring to fire. Such as patent WO2018075590A1, it described that when a turning axis of the string hook and an axis of drawing stroke do not coincide, a seat of the string hook will be in front of the release and restrict the release from rotating. When using the back tension release, the archers are required to hold the release firmly during drawing the bow, and their wrists should continue to exert inward force to maintain restriction of the release on the string hook so as to avoid premature release of the D-ring from the string hook when the turning axis of the string hook and the axis of drawing stroke coincide. After the bow is fully drawn, the archers still need to keep the wrists exerting inward force. When ready to fire, the shoulder blades of the archers are pressed to complete back tension release, and the D-ring is released from the string hook to fire. There will be two disadvantages. First, it is difficult for beginners. Because there are clear rules for wrist actions when drawing the bow, the beginners need to pay attention to their actions all times during the drawing process. In addition, the beginners need great strength to draw the bow. If an accidental firing occurs during the drawing process due to substandard action, under the inertia of the release, the release will hit the beginners in the face risking injury. Second, after mastering the use of the back tension release, the wrist needs to exert inward force every time when the bow is drawn, which will cause muscle fatigue and affect energy of the archers during the game. In addition, range of motion is large during transition from the wrist exert inward force to the wrist extension and then squeezing the shoulder blades, so influence of the back tension release on the bow is greater than that of thumb release.

Some archers may use the back tension release in one game and the thumb trigger release in another game due to fatigue from the back tension release. As a result, the archers must purchase two types of the releases, which can be expensive, and adapting to both modes of operation will decreases muscle memory and reduces agility.

In addition, most of existing releases have fixed size and poor universality.

SUMMARY

The disclosure provides a linkage dual mode release that can be operated by two mode, which can solve the above problems. The linkage dual mode release includes a main body, a string hook, a linkage lock, a thumb trigger, a sear, a trigger bar flange. The main body has a first finger groove arm for placing an index finger of a user. The string hook is elastically pivoted to one end of the main body for releasably hook to a bow string. The linkage lock is elastically pivoted to an outer surface of the main body, and the linkage lock is located adjacent the other end of the main body opposite to the string hook. The linkage lock has a locking arm and a lever arm extending to the main body. The thumb trigger is mounted to the linkage lock extending away from the main body. The sear is pivoted to the main body, and located between the string hook and the linkage lock, a rest member is located between the sear and the main body, the sear comprises a second finger groove arm for placing a middle finger of the user, a first end of the second finger groove arm locks the string hook. The trigger bar flange protrudes from the sear, and extends to the linkage lock and is locked by the locking arm. Wherein the thumb trigger is pulled by a thumb of the user to drive the linkage lock rotate with respective to the main body to enable the sear to be unlocked from the linkage lock that the string hook is driven to unlock from the sear by pressing the string hook to enable the sear to rotate, or, by pulling the thumb trigger continuously to enable the lever arm to push the sear to rotate.

The linkage dual mode release has two release modes for the archers to choose flexibly, and the size of the release can adapt to the individual adjustment of different archers.

DETAILED DESCRIPTION OF THE EMBODIMENTS

In order to make the purpose, technical solution and advantages of the disclosure more clearly, the disclosure is further described in detail in combination with the drawings and embodiments. It is understood that the specific embodiments described herein are used only to explain the disclosure and are not used to define it. On the basis of the embodiments in the disclosure, all other embodiments obtained by ordinary technicians in this field without any creative effort are covered by the protection of the disclosure.

The terms "first", "second", "third", "fourth", if any, in the specification, claims and drawings of this application are used to distinguish similar objects and need not be used to describe any particular order or sequence of priorities. It should be understood that the data used here are interchangeable where appropriate, in other words, the embodiments described can be implemented in order other than what is illustrated or described here. In addition, the terms "include" and "have" and any variation of them, can encompass other things. For example, processes, methods, systems, products, or equipment that comprise a series of steps or units need not be limited to those clearly listed, but may include other steps or units that are not clearly listed or are inherent to these processes, methods, systems, products, or equipment.

It is to be noted that the references to "first", "second", etc. in the disclosure are for descriptive purpose only and neither be construed or implied the relative importance nor indicated as implying the number of technical features. Thus, feature defined as "first" or "second" can explicitly or implicitly include one or more such features. In addition, technical solutions between embodiments may be integrated, but only on the basis that they can be implemented by ordinary technicians in this field. When the combination of technical solutions is contradictory or impossible to be realized, such combination of technical solutions shall be deemed to be non-existent and not within the scope of protection required by the disclosure.

Figure 1:
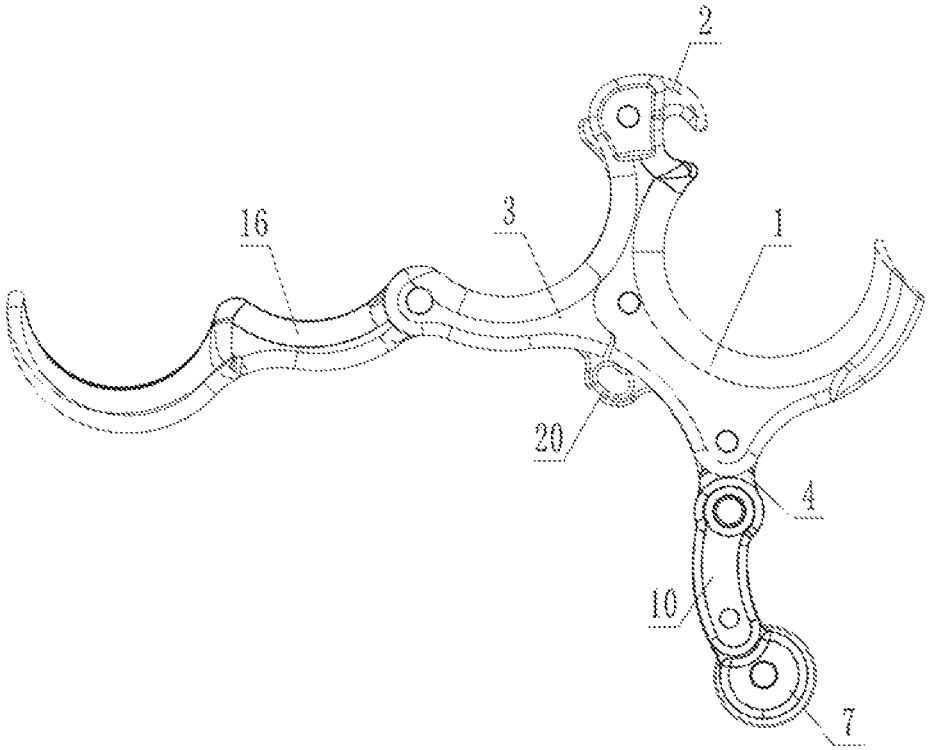
FIG. 1 illustrates a bottom view of a linkage dual mode release in accordance with an embodiment.
Figure 2:
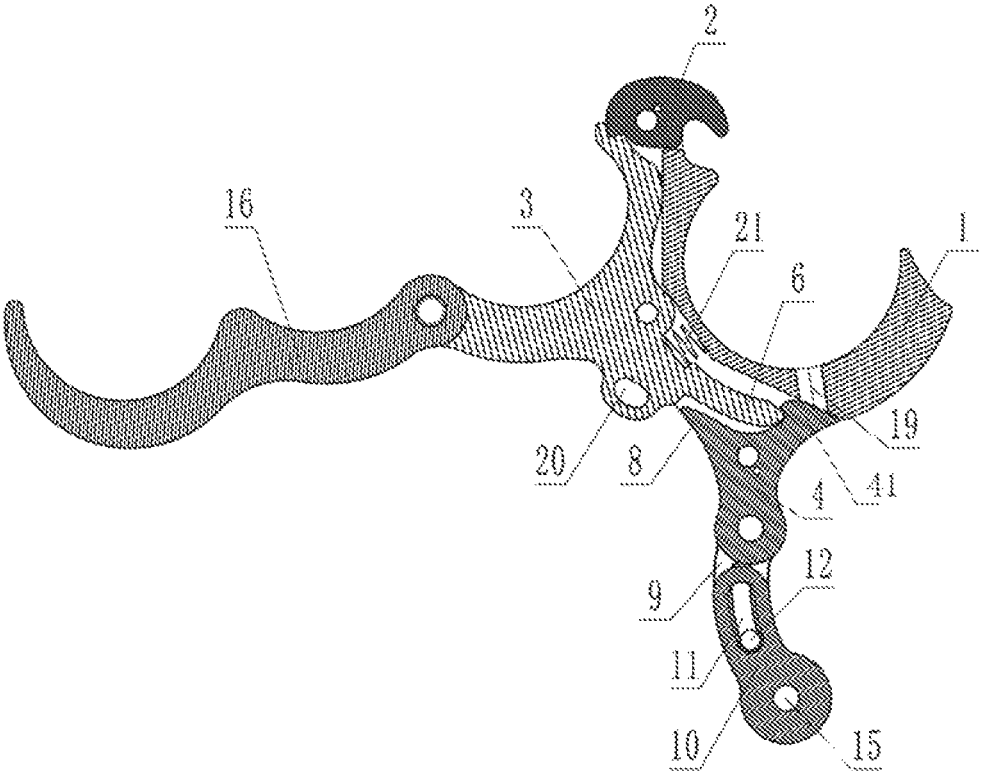
FIG. 2 illustrates a top section view of the linkage dual mode release in accordance with the embodiment.
Figure 3:
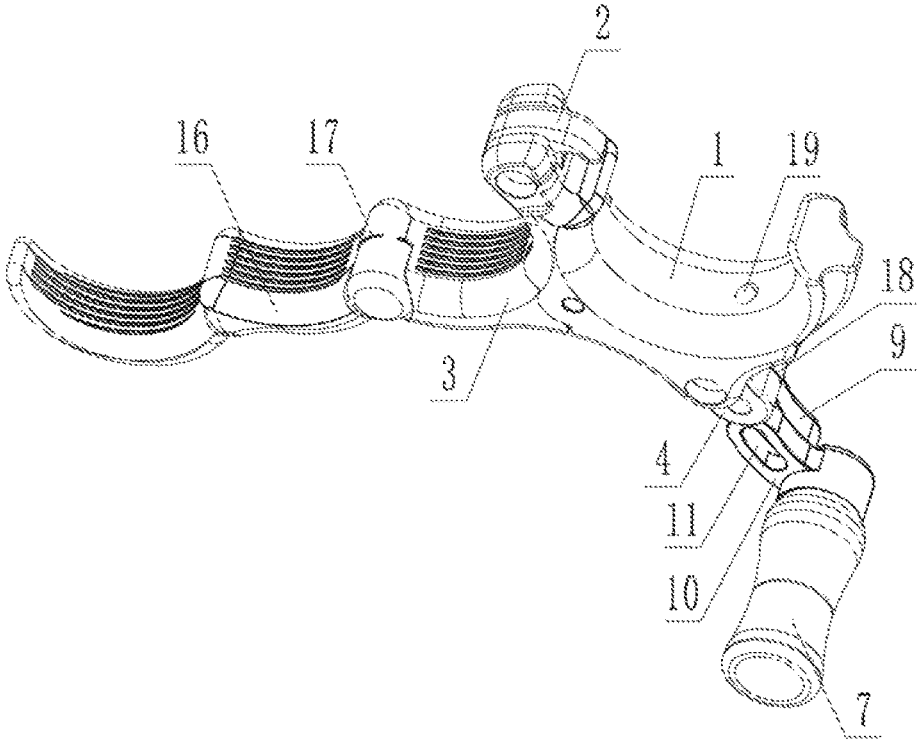
FIG. 3 illustrates a perspective view of the linkage dual mode release in accordance with the embodiment.
Figure 4:
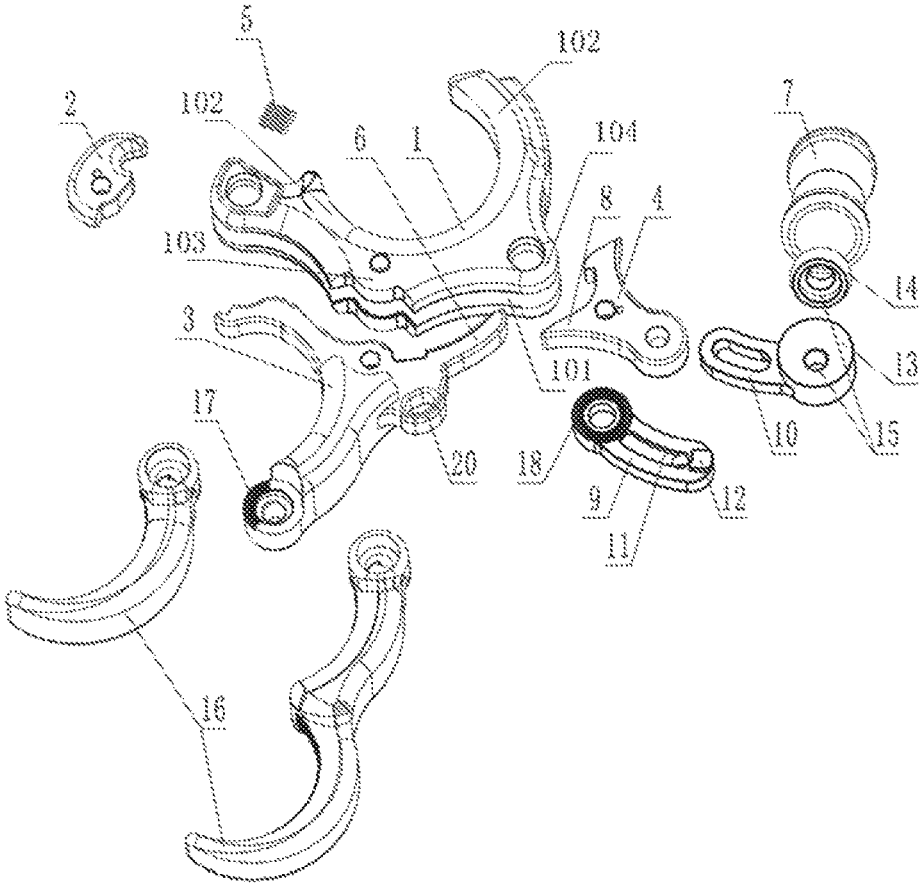
FIG. 4 illustrates a explosive diagram of a linkage dual mode release in accordance with the embodiment.
Figure 5:
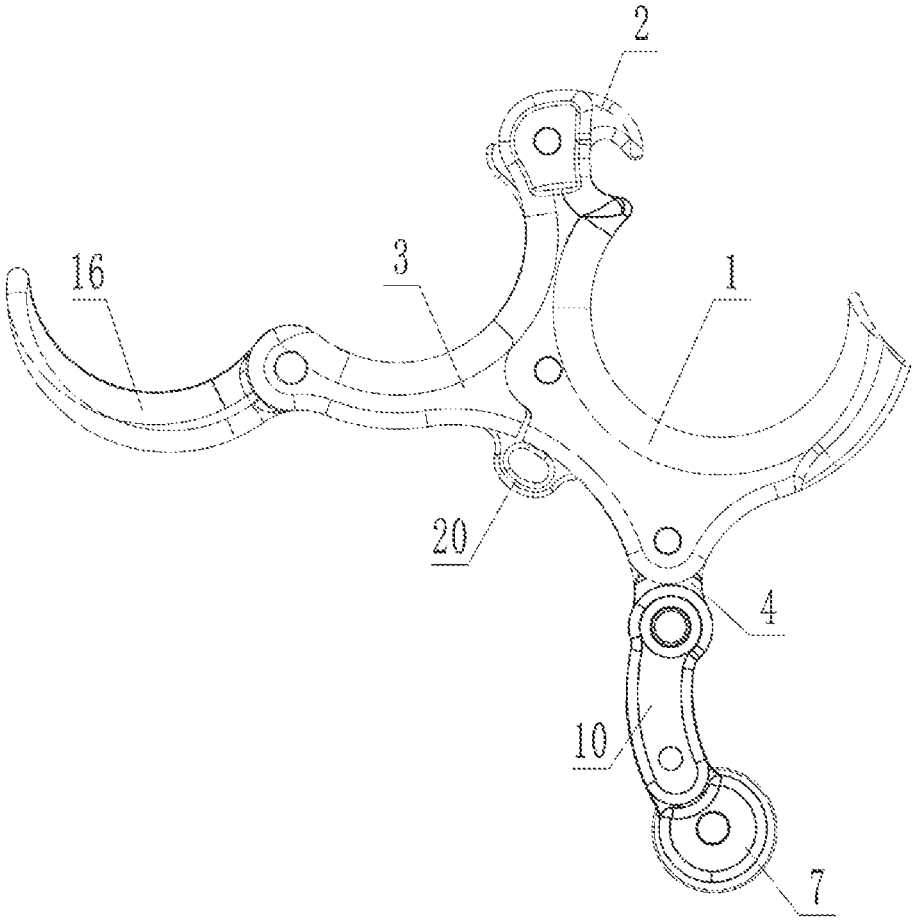
FIG. 5 illustrates a vertical view of a third finger groove that is single finger groove in accordance with the embodiment.

Referring to the FIGS. 1-5, a linkage dual mode release includes a main body 1, a string hook 2, a linkage lock 4, a thumb trigger 7, a sear 3, a trigger bar flange 6. The main body 1 include a first finger groove arm. The main body 1 is shaped like a finger groove arm. In other embodiments, the main body 1 can be other shape. The first finger groove arm includes two opposite end. An outer surface of the main body 1 defines a channel 101 forming by two facing ridges 102 and the main body 1. The first finger groove arm defines a first finger groove for placing an index finger of a user, and the main body 1 further includes a first knob 103 and a second knob 104 protruding from the main body 1 at interval. The first knob 103 and the second knob 104 respectively defines a fixing hole.

The string hook 2 is elastically installed at one end of the main body 1. In detail, the string hook 2 is elastically pivoted to a top end of the main body 1. The string hook 2 is placed in the channel and between the two ridges 102. A first pivot shaft is passed into the two ridges and the string hook 2 to installed the string hook 2 to the main body 1. A reset elastic member 5 is assembled to the first pivot shaft, and the reset elastic member 5 is a torsional spring. Both ends of the torsional spring 5 are extended axially, and are inserted into the string hook 2 and the main body 1 that it reduce installation space and reduce volume of the structure. An end of the string hook 2 not installed to the main body 1 is releasably hook to a bow string (not shown), in detail a D-ring (not shown) attached to the bow string.

The sear 3 is elastically installed to the main body 1. In detail, the sear 3 is placed in the channel 101, a second pivot shaft is passed through the first knob 103 and the sear 3, another reset member 5 is located between the sear 3 and the main body 1. The sear 3 further includes a second finger groove arm and defines a second finger groove for placing the middle finger. A first end of the finger groove arm locks the string hook, a second end of the finger groove arm is engaged with a third finger groove arm 16. A trigger bar flange 6 protrudes from the sear 3 and extending to opposite to the second finger groove. The trigger bar flange 6 is integrated with the second finger groove arm, extends to the linkage lock 4.

The first end of the sear 3 and the trigger bar flange 6 are placed in the channel to cooperated with the main body 1. The sear 3 further include a line ring 20 protruding from the trigger bar flange 6 for allowing a line to pass through for hanging the linkage dual mode release.

The linkage lock 4 is elastically pivoted to the main body 1 that the sear 3 is located between the string hook 2 and the linkage lock 4. In detail, the linkage lock 4 is placed in the channel 101, and a second pivot shaft is mounted the linkage lock 4 to the second knob 104. In other words, the second pivot shaft passes through the linkage lock 4 and the ridges to installed the linkage lock 4 to the main body 1. The linkage lock 4 includes a locking arm 41 and a lever arm 8. The locking arm 41 and the lever arm 8 extend to the main body 1 along different direction, and the locking arm 41 and the lever arm 8 form an angle there between. The locking arm 41 and the lever arm 8 are placed in the channel 101. The locking arm 41 locks the trigger bar flange 6 which extending to the locking arm 41. The lever arm 8 extends toward the line ring 20, and located outside of the trigger bar flange 6 and is away from the main body 1. The linkage lock 4 stops the sear 3 rotating. Meanwhile, front end of the sear 3 is against the string hook 2 to stop the string hook 2 rotating, thus locking the string hook 2. The linkage lock 4 is further connected a thumb trigger 7, which is used to turn the linkage lock 4. When a thumb acts on the thumb trigger 7 to pull the linkage lock 4, the linkage lock 4 overcomes the action of the torsional spring 5 of the linkage lock 4. Then, the linkage lock 4 rotates and separates from the end of the trigger bar flange 6, so that the sear 3 is unlocked. Meanwhile, a middle finger pulls the sear 3 to make the sear 3 rotate, the sear 3 pushes the end of the string hook 2 and separates from the string hook 2, so that the string hook 2 is unlocked and rotates to release D-ring.

The lever arm 8 extends to the outside of the trigger bar flange 6. After the thumb prods the linkage lock 4 to unlocked the sear 3, in addition to pulling the sear 3 with the middle finger, the thumb can also continues to move the linkage lock 4 more sharply, so that the lever arm 8 will push the sear 3 to rotate by squeezing the trigger bar flange 6 to unlock the string hook 2. It is understood that after the locking arm 41 and the lever arm 8, there is two releasing modes to operate the string hook 2 to release the D-ring.

An angle adjustment member 9 is installed between the linkage lock 4 and the thumb trigger 7. One end of the angle adjustment member 9 is installed on the linkage lock 4 by a fixing member, and the thumb trigger 7 is installed on other end of the angle adjustment member 9. After loosening the fixing member, the angle adjustment member 9 can be rotated around the fixing member to adjust angle of the thumb trigger 7.

A distance adjustment member 10 is installed between the angle adjustment member 9 and the thumb trigger 7. The distance adjustment member 10 and the angle adjustment member 9 are all provided with a slidable slot 11. The angle adjustment member 9 is also provided with a limit block 12. The slidable slots 11 of the distance adjustment member 10 and the angle adjustment member 9 overlap together, and the limit block 12 extends into the slidable slots 11 of the distance adjustment member 10. The distance adjustment member 10 and the angle adjustment member 9 are fixed by a fixing member through two slidable slots 11. After loosening the fixing member, the distance adjustment member 10 can slide along the slidable slots 11 relative to the angle adjustment member 9, so as to adjust distance of the thumb trigger 7. The limit block 12 and two ends of the fixing member limit each other so that the angle adjustment member 9 and the distance adjustment member 10 can not rotate.

The slidable slots 11 are arc-shaped, which makes moving path of the distance adjustment member 10 non-linear, so that the distance adjustment member 10 has compensation function of leaning towards the thumb.

Outer end of the distance adjustment member 10 is provided with a receiving portion 13 defining a spherical space 13. An end of the thumb trigger 7 is embedded with a ball 14. The ball 14 and bottom of the receiving portion 13 are all provided with a first threaded hole 15. The ball 14 and the spherical space 13 are formed a spherical joint. The receiving portion 13 and the ball 14 are screwed to the same fixing member through the first threaded holes 15. The thumb trigger 7 is locked after the fixing member is pressed against body of the trigger thumb 7. After loosening the fixing member, the thumb trigger 7 can swing around the ball 14, so as to adjust tilt angle of the thumb trigger 7 to adapt to personalized man-machine efficiency needs of different archers.

An end of the sear 3 that does not contact with the string hook 2 is connected with the third finger groove arm 16 through a fixing member. The third finger groove arm 16 defines a single finger groove or two finger groove, and can be replaced by removing the fixing member so that ring finger and little finger hold the release. After loosening the fixing member, the third finger groove arm 16 can rotate around the fixing member to adjust angle of the third finger groove arm 16, so that the archers can feel subtle movement of the release when preparing to release, so that the archers can better control the release, and also adapt to the personalized man-machine efficiency needs of different archers.

First conical tooth surfaces 17 are arranged at ends of the third finger groove arm 16 and the sear 3 engaged with each other. When the fixing member is tightened, tooth surfaces of the fixing member and the sears engaged with each other, so that the third finger groove arm 16 and the sear 3 can not rotate with respect to each other.

Second conical tooth surfaces 18 is arranged at ends of the angle adjustment member 9 and the linkage lock 4 engaged with each other. When the fixing member is tightened, the second conical tooth surfaces engaged with each other, so that the angle adjustment member 9 and the linkage lock 4 can not rotate with respect to each other.

The main body 1 is further provided with a second threaded hole 19, and the second threaded hole 19 is parallel to tangential direction of the pin shaft of the linkage lock 4. When a fixing member is screwed into the second threaded hole 19, head of the fixing member against the linkage lock 4. The fixing member can be screwed to promote the linkage lock 4 to rotate, so as to adjust initial position of the linkage lock 4 to change length of the trigger bar flange 6 of the sear 3, and realize function of adjusting unlocking sensitivity of the sear 3.

A line ring 20 is arranged on the sear 3, and the release can be hung on wrist or neck after a lanyard is put through the line ring 20.

When using the release, the index finger is located in the finger groove of the main body 1, the middle finger is located in the finger groove of the sear 3, the ring finger and little finger are located in the third finger groove arm 16, and the thumb naturally extends to the thumb trigger 7. The string hook 2 hooks the D-ring to pull back bowstring. After the bowstring is pulled and aimed, the thumb pulls the thumb trigger 7, and the thumb trigger 7 drives the linkage lock 4 to rotate, so that the sear 3 is unlocked, thus completing preparation for releasing the bowstring.

After the sear 3 is unlocked, there are two ways to release the string hook 2 unlock.

First, the archers take the index finger as axis of rotation, and the middle finger naturally exerts force under tension of the bowstring, while the ring finger and little finger exert force together with the middle finger. When the archers make this move, they will automatically and unconsciously squeeze shoulder blades. The sear 3 will rotate by action of back pull of the middle finger, so that the string hook 2 will unlock and rotate by pull of the bowstring, and the D-ring will release from the string hook 2 and the shooting will finished.

Second, after the sear 3 is unlocked, the thumb can directly pull the thumb trigger 7 to further rotate the linkage lock 4, so that the lever arm 8 can contact the trigger bar flange 6 and squeeze the trigger bar flange 6, thus the sear 3 is pushed to rotate and the string hook 2 is unlocked and the shooting will completed.

After shooting, the string hook 2 and the linkage lock 4 reset automatically by action of the torsional spring 5. The sear 3 reset by resetting pressure spring 21.

In the first way, the archers do not need to pull the bow with their wrists exert inward force, thus increasing safety of the drawing process and making it easier for beginners to get started. With the bow drawn and in position, the archers unlock the linkage lock 4 and then release back-up motion, keeping the bowstring tight and in line with arrow. In other words, the process of shooting goes through a two-stage process of tightening the D-ring and releasing the D-ring, without the use of trigger, which effectively solves the target panic of the archers and achieves purpose of conscious aiming and unconscious firing. Also, because there is no need to keep the wrist exert inward during drawing the bow, there is no muscle fatigue for the archers.

In the second way, some archers who are not bothered by target panic, can also shoot with the thumb release, thus minimizing impact on the shooting process with minimal movement.

Automatic reset mechanism of the string hook 2 is compact and does not increase the volume of the release.

The release can adapt to the individual adjustment of different archers, and fixing member specifications of the release are consistent, using the same adjusting tool can be adjusted, so the maintenance cost is low, but also improve production and assembly efficiency.

It should be noted that the embodiments number of this disclosure above is for description only and do not represent the advantages or disadvantages of embodiments. And in this disclosure, the term "including", "include" or any other variants is intended to cover a non-exclusive contain. So that the process, the devices, the items, or the methods includes a series of elements not only include those elements, but also include other elements not clearly listed, or also include the inherent elements of this process, devices, items, or methods. In the absence of further limitations, the elements limited by the sentence "including a . . . " do not preclude the existence of other similar elements in the process, devices, items, or methods that include the elements.

The above are only the preferred embodiments of this disclosure and do not therefore limit the patent scope of this disclosure. And equivalent structure or equivalent process transformation made by the specification and the drawings of this disclosure, either directly or indirectly applied in other related technical fields, shall be similarly included in the patent protection scope of this disclosure.

The invention claimed is:

1. A linkage dual mode release, comprising:

a main body having a first finger groove arm;

a string hook, elastically pivoted to one end of the main body for releasably hook to a bow string;

a linkage lock, elastically pivoted to an outer surface of the main body, and the linkage lock located adjacent the other end of the main body away from the string hook, the linkage lock having a locking arm and a lever arm extending to the main body;

a thumb trigger, mounted to the linkage lock and extending away from the main body;

a sear, pivoted to the main body, and located between the string hook and the linkage lock, a rest member located between the sear and the main body, the sear comprising a second finger groove arm, a first end of the second finger groove arm locking the string hook; and a trigger bar flange, protruding from the sear, and extending to the linkage lock and being locked by the locking arm;

wherein when the thumb trigger is pulled by a thumb of the user, the thumb trigger the linkage lock to rotate, causing the trigger bar flange to be unlocked from the locking arm; and when the linkage lock continues to rotate, the lever arm exerts pressure on the sear to cause the sear to rotate, simultaneously, and the lever arm exerts pressure on the sear to cause the first finger groove arm to rotate, in turn unlocking the string hook from the sear;

wherein the linkage lock is pivoted to the main body via a second pivot shaft, and a second reset member is sleeved on the second pivot shaft and located between the linkage lock and the main body;

wherein the outer surface of the main body defines a channel, which is formed by two facing ridges of the main body, a part of the linkage lock extends into the channel and the second pivot shaft is inserted into the ridges and the linkage lock to enable the second pivot shaft to pivotively mounted to the main body;

wherein the locking arm and the lever arm extend into the channel and resists against the main body; and wherein the first finger groove arm defines a first finger groove, a first knob and a second knob protrudes from the main body at an interval and opposite the first finger groove, the first knob and the second knob are configured to mounted the sear and the linkage lock respectively.

2. The linkage dual mode release of claim 1, wherein the string hook is pivoted to the main body via a first pivot shaft, and a first reset member is sleeved on the first pivot shaft and located between the string hook and the main body.

3. The linkage dual mode release of claim 1, wherein the sear further comprising a second end of the second finger groove arm, the first end of the second finger groove arm and the trigger bar flange placed into the channel, and the second end of the second finger groove arm extends opposite from the main body.

4. The linkage dual mode release of claim 3, further comprising a third finger groove arm pivoted to the second end of the second finger groove arm.

5. The linkage dual mode release of claim 4, wherein the third finger groove arm defines two finger grooves.

6. The linkage dual mode release of claim 1, wherein an angle adjustment member is installed between the linkage lock and the thumb trigger, one end of the angel adjustment member is fixed on the linkage lock, and the thumb trigger is mounted on other end of the angle adjustment member.

7. The linkage dual mode release of claim 6, wherein a distance adjustment member is connected between the angle adjustment number and the thumb trigger, the distance adjustment member is moved with respectively to the angle adjustment number, and moved to or away from the linkage lock.

8. The linkage dual mode release of claim 7, wherein the distance adjustment member and the angle adjustment member respectively defines a first slidable slot and a second slidable slot, the angle adjustment member overlap at the distance adjustment member, and a fixing member is passed through the first slidable slot and the second slidable slot to assemble the angle adjustment member and the distance adjustment member together.

9. The linkage dual mode release of claim 8, wherein the angle adjustment member further comprises a limit block, the limit block is passed through the first slidable slot and the second slidable slot.

10. The linkage dual mode release of claim 8, wherein the first slidable slot and the second slidable slot are arc-shaped, and the fixing member is adjusted a position with respectively to the angle adjustment member and the distance adjustment member to adjust a distance between the linkage lock and the thumb trigger.

11. The linkage dual mode release of claim 8, wherein an end of the distance adjustment member adjacent to the thumb trigger provided with a receiving portion defining a spherical space, a ball bear is embed an end of the thumb trigger, the ball bear and receiving portion are fixed together via a bolt.

12. The linkage dual mode release of claim 11, wherein the receiving portion and the boll bear are respectively define screw holes, the bolt is engaged with the ball bear and the receiving portion via the screw holes.

13. The linkage dual mode release of claim 4, wherein first conical tooth surfaces are place at ends of the third finger groove arm and the sear assembled with each other, the first conical tooth surfaces are engaged with each other that the third finger groove arm and the sear are fixed relatively.

14. The linkage dual mode release of claim 8, wherein second conical tooth surfaces are placed at ends of the angle adjustment member and the linkage lock assembled with each other, the second conical tooth surfaces engaged with each other that the angle adjustment member and the linkage lock are fixed relatively.

* * * * *